US006254408B1

(12) United States Patent
Hattori et al.

(10) Patent No.: US 6,254,408 B1
(45) Date of Patent: Jul. 3, 2001

(54) PLUG-IN CONNECTION STRUCTURE

(75) Inventors: Tetsuya Hattori; Yoshiaki Kato, both of Aichi (JP)

(73) Assignee: Kabushiki Kaisha Tokai Rika Denki Seisakusho, Aichi (JP)

( * ) Notice: Subject to any disclaimer, the term of this patent is extended or adjusted under 35 U.S.C. 154(b) by 0 days.

(21) Appl. No.: 09/354,150

(22) Filed: Jul. 16, 1999

(30) Foreign Application Priority Data

Jul. 16, 1998 (JP) ..... 10-201724

(51) Int. Cl.[7] ..... H01R 13/62
(52) U.S. Cl. ..... 439/157; 439/248
(58) Field of Search ..... 439/157, 160, 439/247, 248

(56) References Cited

U.S. PATENT DOCUMENTS 4,954,085 * 9/1990 Inou et al. ..... 439/248
5,292,267 * 3/1994 Kobayashi et al. ..... 439/247

FOREIGN PATENT DOCUMENTS

603890 A2 * 6/1994 (EP) ..... 439/157

* cited by examiner

*Primary Examiner*—Renee Luebke
*Assistant Examiner*—Briggitte Hammond
(74) *Attorney, Agent, or Firm*—Birch, Stewart, Kolasch & Birch, LLP

(57) ABSTRACT

A plug-in connecting structure where a first unit, on an outer surface of which a first connector housing is installed, and a second unit, on an outer surface of which a second connector housing is installed, are connected electrically with each other by connecting the connector housings with each other, simultaneously with the mechanical connection of the units with a certain support being as a guide. When advancing toward a connecting portion of the second connector housing, a connecting portion of the first unit automatically aligns its center axis with a center axis of the connecting portion of the second connector housing, with being guided by a tapered surface. The first and second connector housings are never forcibly connected with each center axis thereof remaining offset from each other.

12 Claims, 7 Drawing Sheets

PLUG-IN CONNECTION STRUCTURE

BACKGROUND OF THE INVENTION

1. Field of the Invention

The present invention relates to a plug-in connection structure wherein a pair of predetermined units are electrically connected with each other simultaneously with mechanical connection thereof.

2. Description of the Related Art

For example, a plug-in connection structure is employed for electrically connecting a roll connector, fixed to a steering column, with a steering wheel which is to be attached to the steering column. Generally, in a plug-in connection structure, when a unit and another unit are connected with each other with a predetermined support being as a guide, connector housings arranged on the outer surface of each unit are connected with each other with the connection of the units, so that the mechanical and electrical connection of the units are simultaneously realized. In the above example, "a predetermined support"corresponds to the steering column, and "a unit" and "another unit" correspond to the steering wheel and the roll connector, respectively.

In such a plug-in connection structure, relative position of two units as a whole is restricted by a support serving as a guide, and on the outer surface of the units there are fixed first and second connector housings which are to be connected with each other in a male and female connecting manner. The first and second connector housings fixed thereon in such a way are connected with each other simultaneously with the mechanical connection of the units. Therefore, it is necessary to precisely arrange each connector housing at a predetermined position on the outer surface of each unit. In case that this precision is inferior, since the offset connector housings are forcibly connected, some stress is applied on a contact terminal, thus causing insufficient contact due to deflection or deformation of the terminal.

SUMMARY OF THE INVENTION

Therefore, it is an object of the present invention to provide a plug-in connection structure wherein even if each connector housing, arranged on each of outer surfaces of units which are to be connected with each other, is swerved or dislocated from a predetermined position thereon, suitable connection of the connector housings can be realized.

In order to achieve the object of the present invention, there is provided a plug-in connection structure wherein a first unit, on an outer surface of which a first connector housing is provided, and a second unit, on an outer surface of which a second connector housing is provided, are connected electrically with each other by connecting the first connector housing and the second connector housing with each other, simultaneously with mechanical connection of the first unit and second unit with each other with a predetermined support being as a guide. The first connector housing has a first base provided on the outer surface of the first unit, and has a first connecting portion which is projected from the first base and which is connected to the first base so as to slide along the outer surface of the first unit relatively to the first base. The second connector housing has a second base provided on the outer surface of the second unit, and has a second connecting portion surrounded by a peripheral wall which is projected from the second base and which has a tapered inner surface widening towards a free edge of the peripheral wall. One of the first base and the second base is detachably attached to the outer surface. A retracting pin is fixed to the first connector housing. A retracting lever is pivotably mounted on the peripheral wall of the second connector housing. The retracting lever engages with the retracting pin and can pivot toward the second unit to pull the first connector housing toward the second unit so that the first connecting portion and the second connecting portion are connected with each other.

In the plug-in connection structure of the present invention as above, when the first and second units are made approach to each other to be connected, firstly, the first connecting portion of the first connector housing is located inside the tapered peripheral wall of the second connector housing. As the first and second units further approach each other, the tapered inner surface of the peripheral wall becomes narrower, and at the narrowest location thereof there exists the second connecting portion of the second connector housing. On the other hand, the first connecting portion of the first connector housing can slide along the surface of the first unit. Thanks to this, when advancing toward the second connecting portion of the second connector housing, the first connecting portion of the first connector housing automatically aligns its center axis with the center axis of the second connecting portion of the second connector housing, and is guided by the tapered surface.

Further, since the retracting lever pivotally mounted on the peripheral wall is engaged with the retracting pin which is fixed to the first connector housing, when the retracting lever is pivoted toward the second unit finally, one of the first and second connector housing is released from the associated unit surface, so that the connection of the first and second connector housings is completed. That is, the first and second connector housings are never forcibly connected with each center axis thereof remaining offset.

In the plug-in connection structure of the present invention, the first connecting portion of the first connector housing may comprise a body having a cross-shaped cross section. The first connecting portion of the first connector housing may slide in a normal direction relatively to a connecting direction of the first unit and the second unit.

The plug-in connection structure of the present invention may further comprise a holding means to hold the retracting lever at a retracting position at which the retracting lever is positioned on a side of the second unit. The holding means preferably comprises a holding hook projected from the second base, and a tip part of the retracting lever in which the holding hook and the tip part can engage with each other.

The plug-in connection structure of the present invention may further comprise a fixing means to temporally fix a relative position of the first connecting portion and the first base. The fixing means preferably comprise a holding protrusion provided on the first base, and a holding portion extending from the first connecting portion nearly to a surface of the first base so as to be able to elastically engage with the holding protrusion.

In the above description, the first connecting portion projecting from the first base of the first connector housing is made to be able to slide relatively to the first base. Alternatively, the second connecting portion of the second connector housing surrounded by the peripheral wall can be made to be able to slide with the peripheral wall relatively to the second base. With this alternation, the same benefit is also brought.

BRIEF DESCRIPTION OF THE DRAWINGS

This and other objects and features of the present invention will become clear from the following description taken in conjunction with the preferred embodiment thereof with reference to the accompanying drawings, in which.

DETAILED DESCRIPTION OF THE PREFERRED EMBODIMENT

Figure 1:
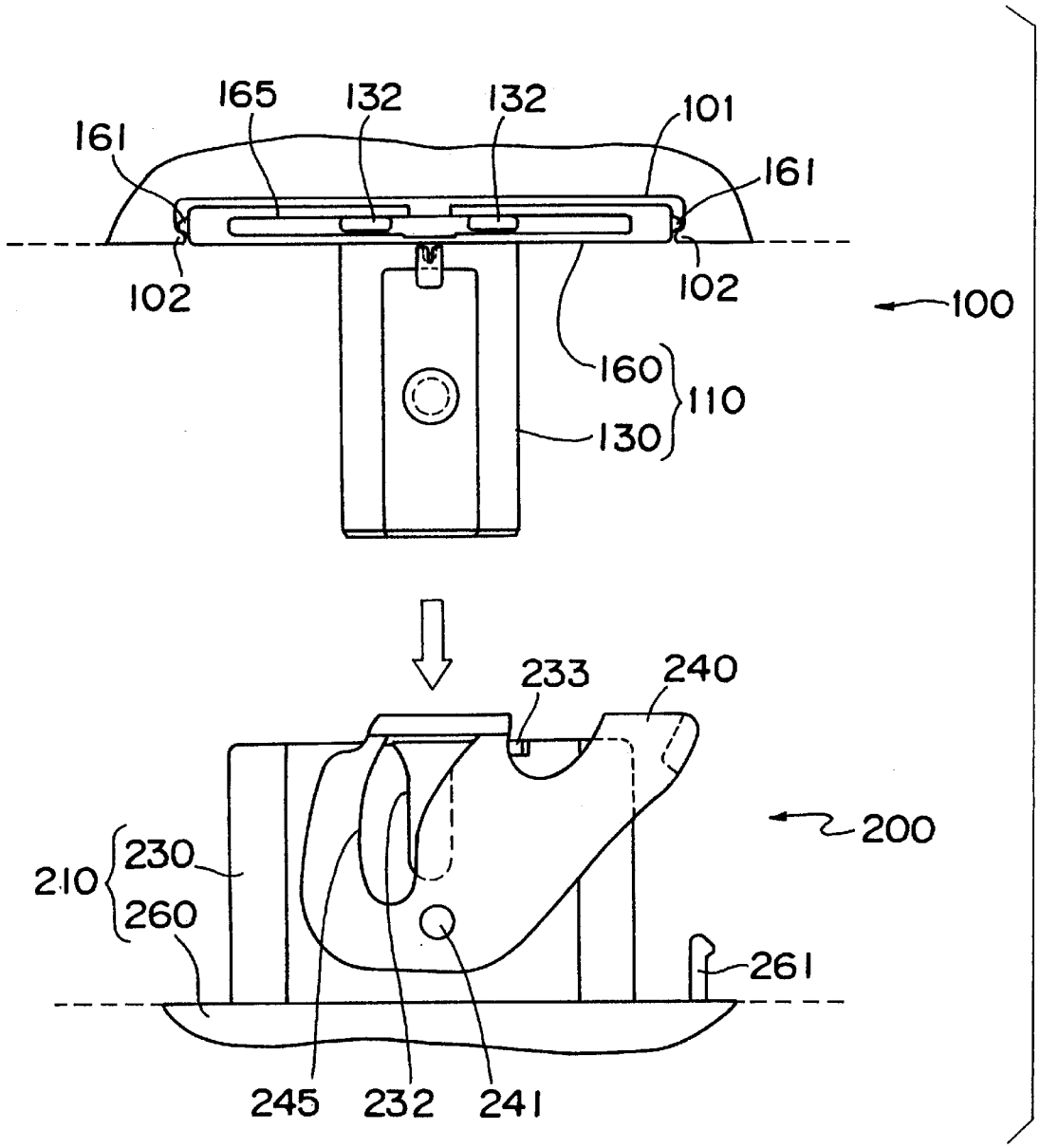
FIG. 1 is an explanatory view showing two units, before the connection, which are to be connected with each other with a plug-in connection structure of the present invention.
Figure 2:
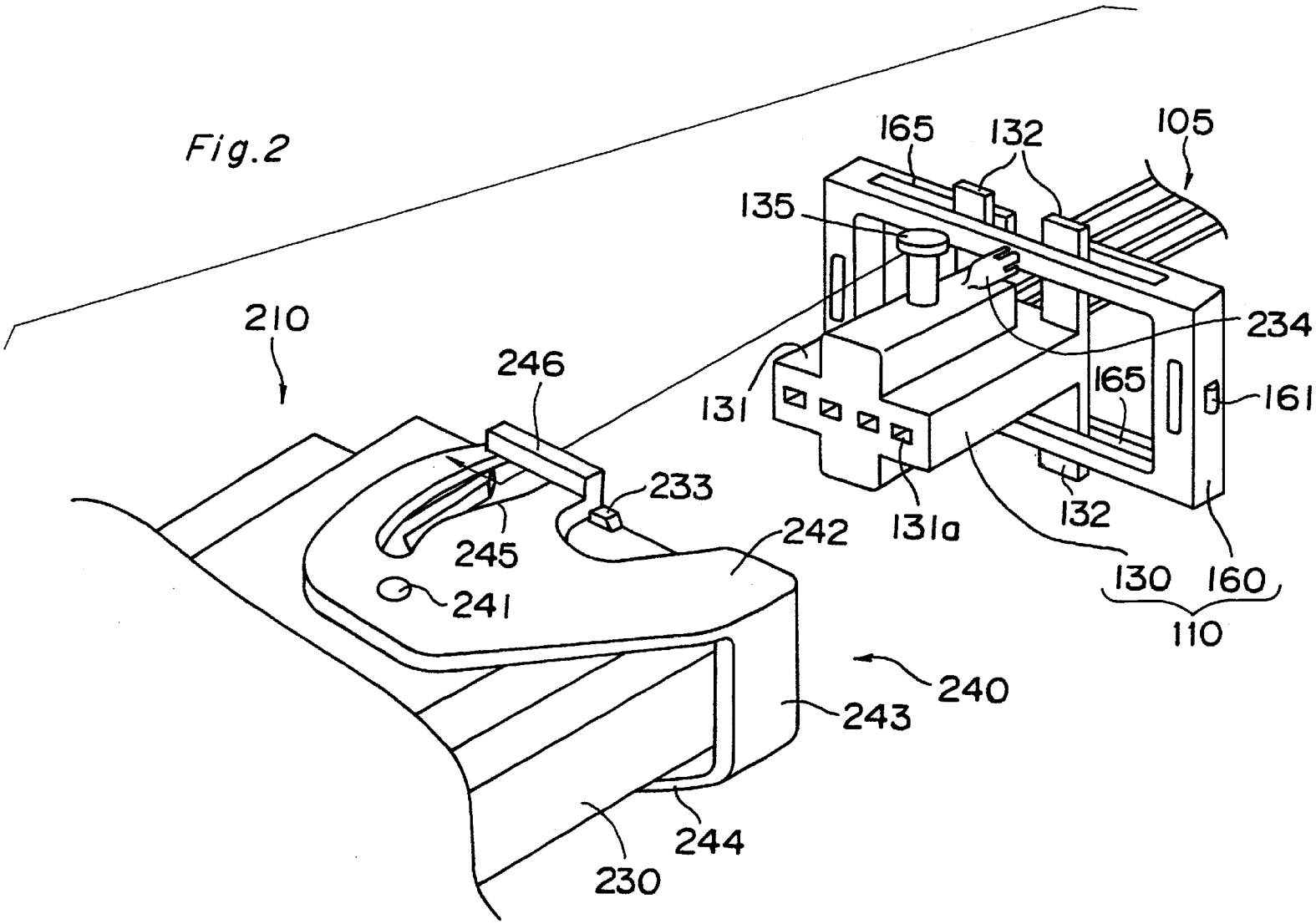
FIG. 2 is a partial perspective view of the first and second connector housings shown in FIG. 1.

The preferred embodiment of the present invention is described below in detail with reference to the accompanying drawings. FIG. 1 shows main portions of a first unit 100 and a second unit 200 before connection, in a state wherein they are close to each other. FIG. 2 is a perspective view which shows a first connector housing 110 fixed to the first unit 100 and a second connector housing 210 fixed to the second unit 200. In the present invention, the first unit 100 and the second unit 200 are not limited to particular ones. For example, the present invention is applied to a case wherein the first unit 100 is a steering wheel, and the second unit 200 is a roll connector which is to be connected to the steering wheel mechanically and electrically.

As shown in FIG. 2, the first connector housing 110 comprises a base (first base) 160 shaped like a rectangular frame, and a connecting portion (first connecting portion) 130 which is projected from the base 160 and encloses, or accommodates, contact terminals. The base 160 is detachably fixed to a recess 101 formed on the outer surface of the first unit 100. That is, as shown in FIG. 1, on the two opposed side members of the frame-like base 160, there are arranged holding protrusions 161, and on the corresponding side walls of the recess 101, there are also arranged holding protrusion 102. Thus, the base 160 is normally held in the recess 101. But under a pulling force, the elastic engagement of the holding protrusions 161 and 102 is released, or detached, so that the base 160 is released from the recess 101; in other words, the first connector housing 110 is released from the recess 101. Although not shown in FIG. 1, electric wires 105 are running from the first connector housing 110 into the first unit 100 (FIG. 2).

The connecting portion 130 is mounted to the base 160 so as to slide along the base surface. Thus, when the first connector housing 110 is fixed on the first unit 100, the connecting portion 130 can slide along the surface of the first unit 100. The connecting portion 130 comprises a body 131 having a cross-shaped cross section and enclosing contact terminals, and four sliding legs 132 fixed to an end of the body 130 so as to extend in normal direction to the body 130. Each sliding leg is an elongated plate-like member, and they all exist in one plane. There are two pairs of sliding legs, each pair thereof comprising two sliding legs extending in parallel; thus there are four sliding legs in total. Two pairs of the extending legs are extending in opposite direction. As to the sliding legs, alternatively, there can be employed four legs extending in cross-shape, other than that shown in FIG. 2. Of course, in that case, the constitutions of the base 160 and the recess 101 of the first unit 100 are accordingly modified.

On the other hand, at each of two opposed side members of the rectangular frame-like base 160, an elongated guide slot 165 is formed respectively. Into these guide slots 165, the sliding legs 132 are slidably inserted. Thus, as can be understood from FIG. 2, the connecting portion 130 can freely slide relatively to the base 160 along the surface thereof. From one wall surface of the connecting portion 130, there is projected a retracting pin 135 which is utilized at the time of retracting (pulling) the first connector housing 110 into the second connector housing 210. The function of this retracting pin 135 will be described below.

Figure 3:
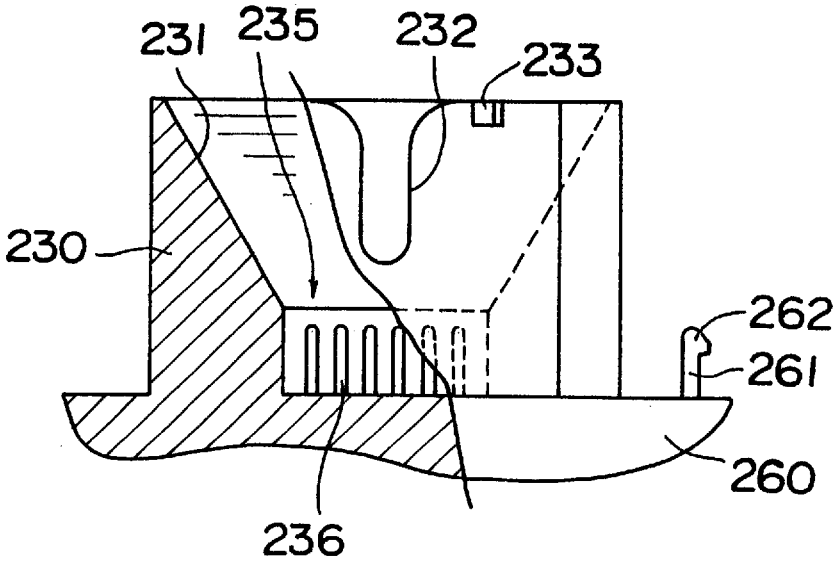
FIG. 3 is a partially broken cross sectional view of the second connector housing shown in FIG. 1.

The second connector housing 210 comprises a base (second base) 260 which is fixed to the second unit 200, and a connecting portion (second connecting portion) 235 surrounded by a peripheral wall 230 projected from the base 260. In FIG. 2, the peripheral wall 230 is solo shown with a retracting lever 240 pivotably mounted thereon. FIG. 3 is a side elevation partially broken away to explain the constitution of the second connector housing 210. In FIG. 3, showing the retracting lever 240 is omitted.

The peripheral wall 230 is surrounding the connecting portion 235 of the second connector housing 210, and the inner surface 231 thereof is tapered so as to widen towards a free edge of the peripheral wall 230. The connecting portion 235 is located at the narrowest position inside the peripheral wall 230. The connecting portion 235 comprises a plurality of contact terminals 236. Each contact terminal 236 is inserted into an connection opening 131*a* formed at the front face of the connecting portion body 131, and connected to the contact terminal (not shown) enclosed in the first connector housing 110. On one wall portion of the peripheral wall 230 there is formed a straight retracting guide inlet 232, and on the base 260 there is projected a holding hook 261. The functions of these guide inlet 232 and holding hook 261 will be described below.

As shown in FIGS. 1 and 2, on the peripheral wall 230, there is pivotaly mounted the retracting lever 240. The retracting lever 240 is constituted by connecting two side walls 242 and 244, extending in parallel, with a connecting plate 243. The retracting lever 240 can pivot about a center shaft 241 between a receiving position shown in FIG. 1 and a retracting position shown in FIG. 5. The retracting lever 240 is held at the receiving position by a holding protrusion 233, and is held at the retracting position by the holding hook 261. On one side-plate, there is formed a curved retracting inlet 245. The function of this retracting inlet 245 will be described below.

The actual connecting procedure of the plug-in connection structure of the embodiment is described hereinafter. In FIG. 2, showing each unit is omitted, and the first connector housing 110 and the second connector housing 210 are shown. Firstly, the first and second units 100 and 200, on which the respective connector housings are mounted, are made approach to each other (FIG. 1). Then, as shown by an arrow in FIG. 2, the retracting pin 135 is made pass below a bridge 246 into the inlet 245 of the retracting lever 240. Now, the connecting portion 130 projected from the first connector housing 110 is placed inside the tapered peripheral wall 230.

Figure 4:
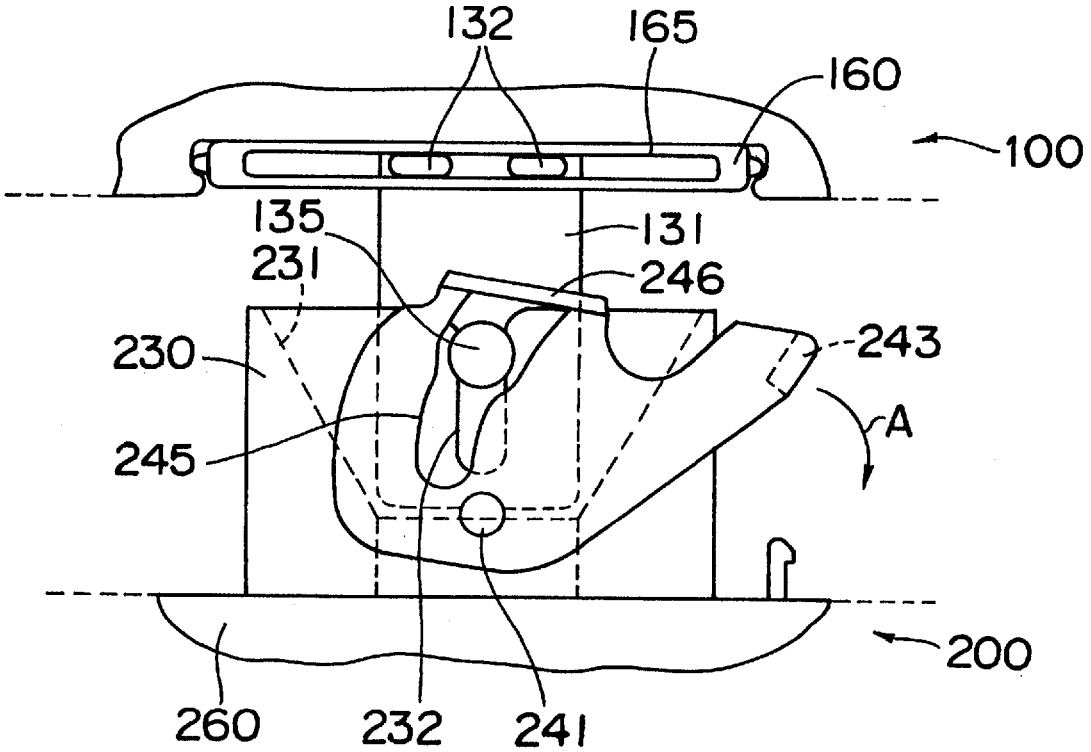
FIG. 4 is an explanatory view showing the retracting lever pivotally mounted on the second connector housing shown in FIG. 1, in which the retracting lever is in a receiving position.

From this condition, the first and second units 100 and 200 are forced toward to each other, so that the connection openings 131*a* of the first connector housing 110 and the contact terminals 236 of the second connector housing 210 are positioned face to face in alignment (namely, without relative positional offset). This condition is shown in FIG. 4. As described above, the connecting portion 130 can freely slide along the surface of the base 160 fixed on the first unit 100, that is, along the surface of the first unit 100. Accordingly, even if there is some offset between the location of the first connector housing 110 on the first unit 100 and the location of the second connector housing 210 on the second unit 200, the connecting portion 130 slides along the surface of the first unit 100 while being guided by the tapered inner surface 231 of the peripheral wall 230. The connecting portion 130 advances toward the connecting portion 235 of the second connector housing 210, and the connection openings 131*a* of the first connector housing 110 and the contact terminals 236 of the second connector housing 210 are brought face to face in alignment (namely, without relative positional offset).

In the condition of FIG. 4, respective positions of the first and second units 100 and 200 are fixed on a predetermined support, and the both units do not approach to each other any more. For example, in the case of the steering wheel and the roll connector as described above, the respective positions of them are fixed to that shown in FIG. 4 on the steering column as a support, so that the relative position of them are restricted. In FIG. 4, the retracting lever 240 is shown in a position slightly pivoted from the receiving position in FIG. 1 toward the second unit 200.

From the condition of FIG. 4, when the retracting lever 240 is pivoted in direction of an arrow "A", the retracting pin 135 located in the retracting inlet 245 of the lever 240 is retracted or pulled into the peripheral wall 230 of the second connector housing 210 by the pivoting movement of the lever 240. Simultaneously with this, the base 160 of the first connector housing 110 is released or detached from the first unit 100. It is to be noted that the electrical connection between the first connector housing 110 and the first unit 100 is of course kept.

Figure 5:
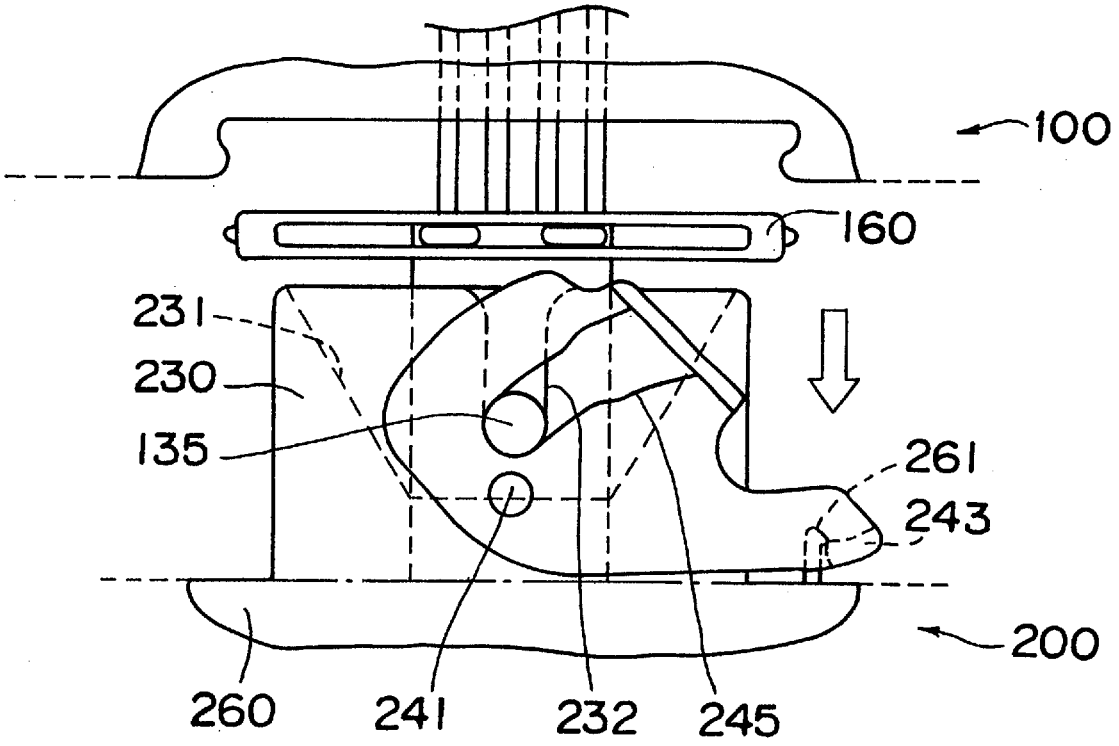
FIG. 5 is an explanatory view showing the retracting lever having been pivoted to a retracting position from the receiving position in FIG. 4.

When the retracting pin 135 is retracted by the retracting lever 240, the pin 135 advances straight toward the second unit 200 in the retracting guide inlet 232 which is formed straight on the peripheral wall 230 of the second connector housing 210. Then, the contact terminals 236 of the second connector housing 210 are inserted into the connection openings 131*a* of the first connector housing 110, so that the electrical connecting of the first unit 100 and second unit 200 is completed. This condition is shown in FIG. 5. It is convenient to pivot the retracting lever 240 by manipulating the connecting plate 243 with fingers. In FIG. 5, one edge of the connecting plate 243 is engaged with a holding protrusion 262 at the tip of the holding hook 261, so that the retracting lever 240 is held in that position.

The releasing procedure of the two units 100 and 200 which have been connected electrically and mechanically as above is vice versa. Its brief explanation is as follows. The retracting lever 240 of the second connector housing 210 is pivoted from the retracting position in FIG. 5 to the receiving position in FIG. 4, and the first connector housing 110 is again engaged with the first unit 100 at the base 160 thereof. Then, the retracting pin 135 of the first connector housing 110 is passed below the bridge 246 so as to be released from the retracting inlets 232 and 245. A sloped surface 136*a* is partially formed on the head 136 of the retracting pin 135, so the retracting pin 135 can easily pass below the bridge 246 (FIG. 6).

Figure 6:
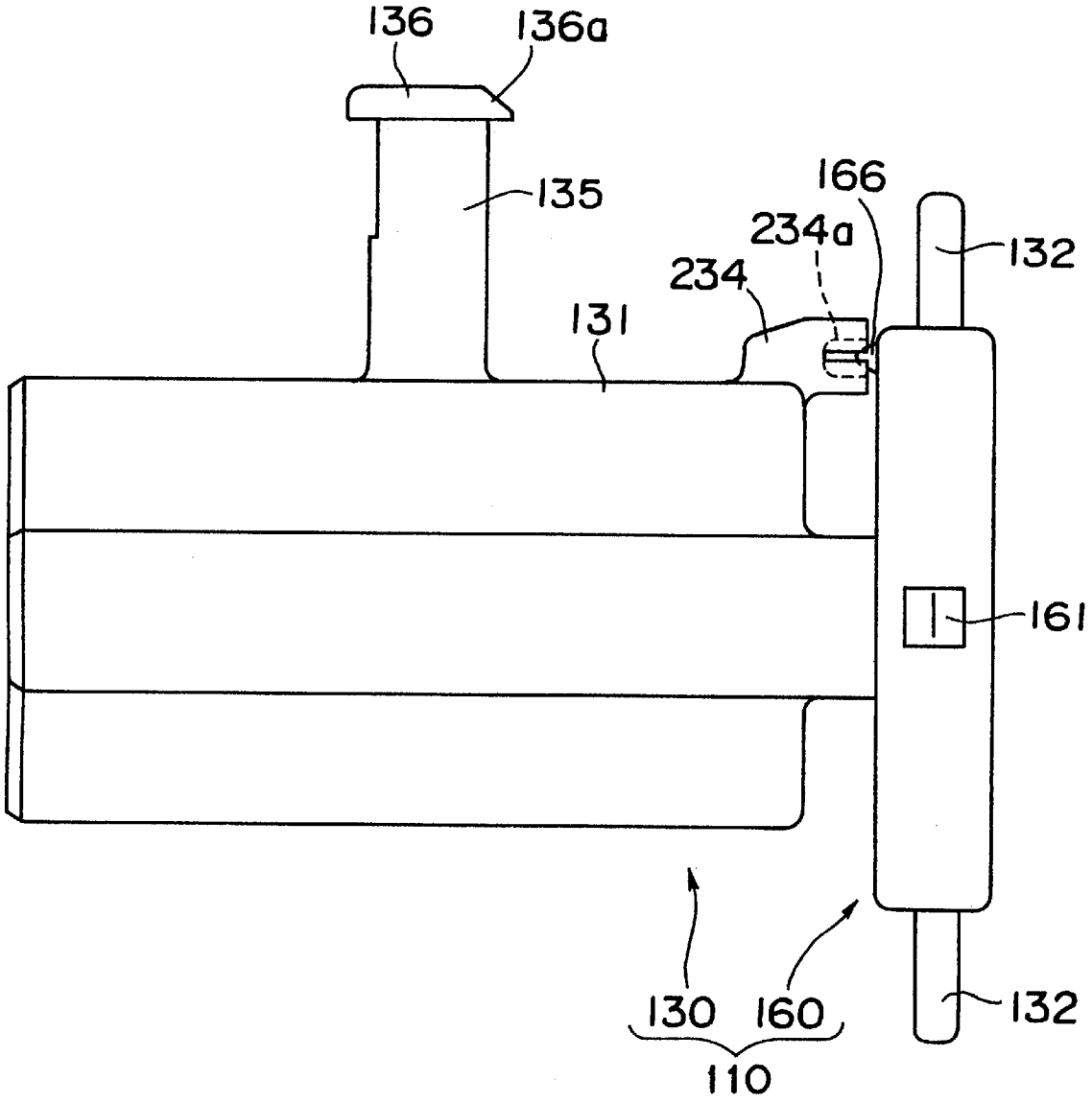
FIG. 6 is a side elevation of the first connector housing shown in FIG. 1.

FIG. 6 shows a side elevation of the first connector housing 110. From the edge, facing the base 160, of the connecting portion body 131, there is formed a holding portion 234 extending nearly to the surface of the base 160. This holding portion 234 is elastically engaged with a holding protrusion 166 on the base 160 to temporarily fix the relative position of the connecting portion 130 to the base 160. From FIG. 6, it can be understood that the holding protrusion 166 of the base 160 is engaged in a recess 234*a* at the edge of the holding portion 234.

In the shown embodiment, the base 160 and the connecting portion 130 of the first connector housing 110 slide relatively toward to each other, and the peripheral wall 230 surrounding the connecting portion 235 and the base 260 of the second connector housing 210 are integratedly formed so as not to slide to each other. In the present invention, however, an opposed construction can be employed. That is, the base 160 and the connecting portion 130 of the first connector housing 110 can be integratedly formed so as not toward slide to each other, and the peripheral wall 230 surrounding the connecting portion 235 and the base 260 of the second connector housing 210 can relatively slide toward each other. With such the opposed construction, the same benefit is also realized.

Figure 7:
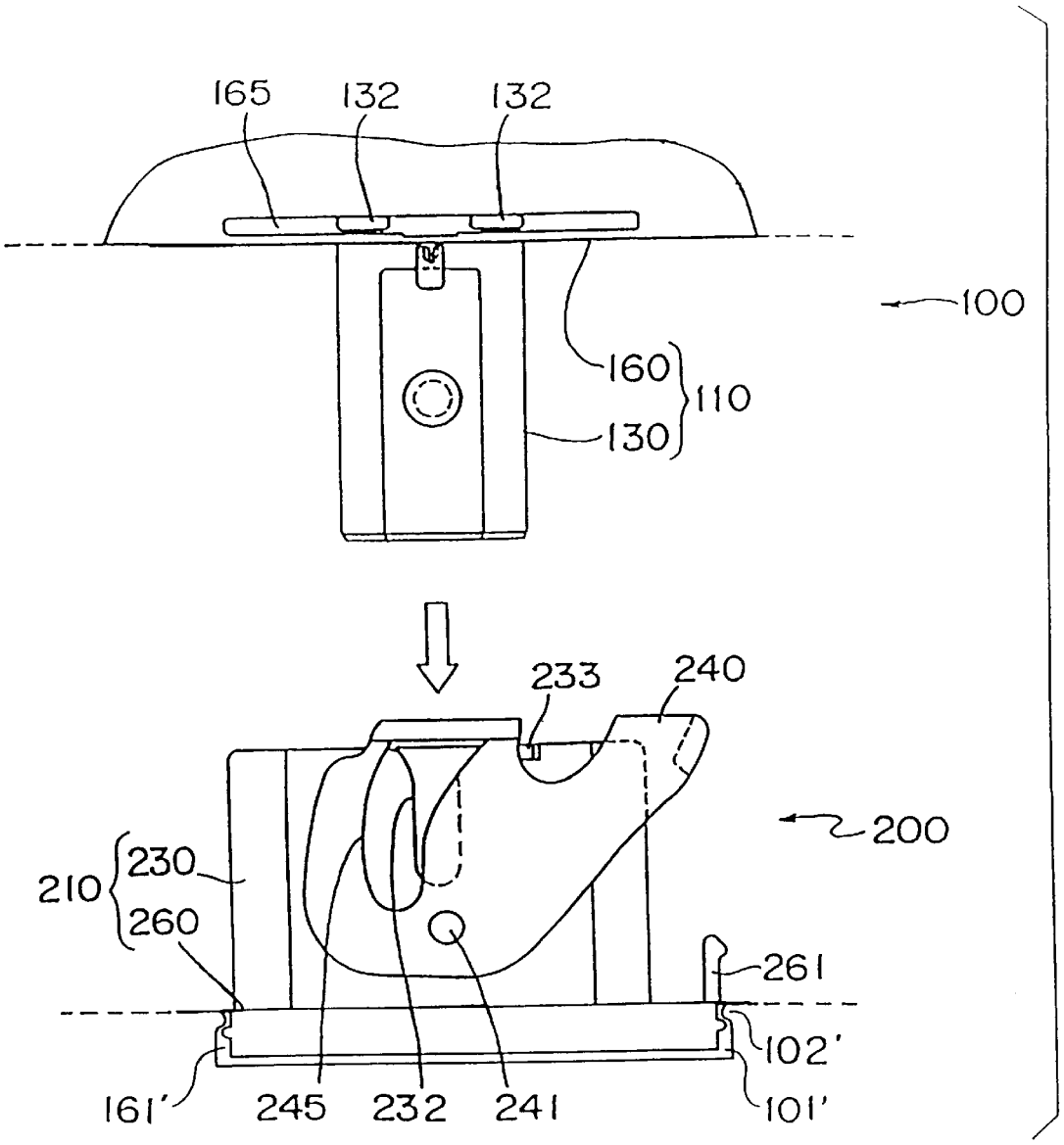
FIG. 7 is an explanatory view showing two units, before the connection, which are to be connected with each other with a plug-in connection structure of the present invention.
Figure 8:
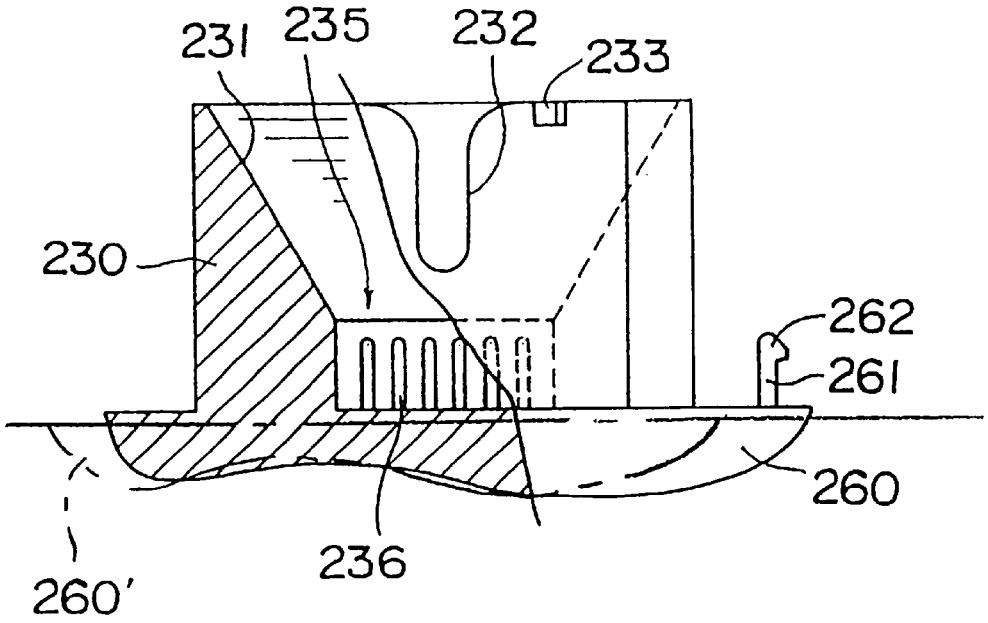
FIG. 8 is a partially broken cross sectional view of the second connector housing shown in FIG. 7.

Further, when pivoting the retracting lever 240 to connect the first and second connector housings 110 and 210, the second connector housing 210 rather than the first connector housing 110 can be released from the associated unit. As seen in FIG. 7, a recess 101' is provided near an outer surface of the second unit 200. This second embodiment including corresponding protrusions 102', 161'. FIG. 8 shows how the second peripheral wall 230 can slide relatively toward the second base 260 as opposed to the relative movement of components 130 and 160 in the first embodiment. Two positions 260 and 260' are shown to demonstrate the change in relative positions.

Although the present invention has been fully described in connection with the preferred embodiment thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A plug-in connection structure wherein a first unit, on an outer surface of which a first connector housing is provided, and a second unit, on an outer surface of which a second connector housing is provided, are connected electrically with each other by connecting the first connector housing and the second connector housing with each other, simultaneously with mechanical connection of the first unit and the second unit with each other with a predetermined support being as a guide, characterized in that the first connector housing has a first base provided on the outer surface of the first unit, and has a first connecting portion which is projected from the first base and which is connected to the first base so as to slide along the outer surface of the first unit relatively to the first base;

the second connector housing has a second base provided on the outer surface of the second unit, and has a second connecting portion surrounded by a peripheral wall which is projected from the second base which has a tapered inner surface widening towards a free edge of the peripheral wall;

one of the first base and the second base is detachably attached to its respective outer surface;

a retracting pin is fixed to the first connector housing; and a retracting lever is pivotably mounted on the peripheral wall of the second connector housing, wherein the retracting lever engages with the retracting pin and can pivot toward the second unit to pull the first connector housing toward the second unit so that the first connecting portion and the second connecting portion are connected with each other.

2. The plug-in connection structure of claim 1, wherein the first connecting portion of the first connector housing comprises a body having a cross-shaped cross section.

3. The plug-in connection structure of claim 1, wherein the first connecting portion of the first connector housing slides in a normal direction relatively to a connecting direction of the first unit and the second unit.

4. The plug-in connection structure of claim 1, further comprising a holding means to hold the retracting lever at a retracting position at which the retracting lever is positioned on a side of the second unit.

5. The plug-in connection structure of claim 4, wherein the holding means comprises a holding hook projected from the second base, and a tip part of the retracting lever in which the holding hook and the tip part can engage with each other.

6. The plug-in connection structure of claim 1, further comprising a fixing means to temporarily fix a relative position of the first connecting portion and the first base.

7. The plug-in connection structure of claim 6, wherein the fixing means comprises a holding protrusion provided on the first base, and a holding portion extending from the first connecting portion nearly to a surface of the first base so as to be able to elastically engage with the holding protrusion.

8. A plug-in connection structure wherein a first unit, on an outer surface of which a first connector housing is provided, and a second unit, on an outer surface of which a second connector housing is provided, are connected electrically with each other by connecting the first connector housing and the second connector housing with each other, simultaneously with mechanical connection of the first unit and the second unit with each other with a predetermined support being as a guide, characterized in that the first connector housing has a first base provided on the outer surface of the first unit, and has a first connecting portion which is projected from the first base;

the second connector housing has a second base provided on the outer surface of the second unit, and has a second connecting portion surrounded by a peripheral wall which is projected from the second base, said peripheral wall is connected to the second base so as to slide along the outer surface of the second unit relatively toward the base, and which has a tapered inner surface widening towards a free edge of the peripheral wall;

one of the first base and the second base is detachably attached to its respective outer surface;

a retracting pin is fixed to the first connector housing; and a retracting lever is pivotably mounted on the peripheral wall of the second connector housing, wherein the retracting lever engages with the retracting pin and can pivot toward the second unit to pull the first connector housing toward the second unit so that the first connecting portion and the second connecting portion are connected with each other.

9. The plug-in connection structure of claim 8, wherein the first connecting portion of the first connector housing comprises a body having a cross-shaped cross section.

10. The plug-in connection structure of claim 8, wherein the peripheral wall of the second connector housing slides in a normal direction relatively to a connecting direction of the first unit and the second unit.

11. The plug-in connection structure of claim 8, further comprising a holding means to hold the retracting lever at a retracting position at which the retracting lever is positioned on a side of the second unit.

12. The plug-in connection structure of claim 11, wherein the holding means comprises a holding hook projected from the second base, and a tip part of the retracting lever in which the holding hook and the tip part can engage with each other.

* * * * *